US006209729B1

(12) United States Patent
Brouillard

(10) Patent No.: US 6,209,729 B1
(45) Date of Patent: Apr. 3, 2001

(54) POOL SCOOP

(76) Inventor: John P. Brouillard, 335 W. Los Alamos St., Gilbert, AZ (US) 85233

( * ) Notice: Subject to any disclaimer, the term of this patent is extended or adjusted under 35 U.S.C. 154(b) by 0 days.

(21) Appl. No.: 09/314,903

(22) Filed: May 20, 1999

(51) Int. Cl.[7] ..... B01D 35/00

(52) U.S. Cl. ..... 210/470; 210/464; 210/465; 209/418; 15/1.7

(58) Field of Search ..... 210/470, 495, 210/499, 438, 237, 238, 464–465; 15/257.1, 1.7, 250.361, 250.39; 16/115; 209/418–419

(56) References Cited

U.S. PATENT DOCUMENTS 592,583 * 10/1897 Eads .
902,954 * 11/1908 Felty .
1,094,161 * 4/1914 Mueller .
1,234,835 * 7/1917 Watkins .
3,188,668 * 6/1965 Buckelew .
3,220,037 * 11/1965 Ruhling .
3,368,686 * 2/1968 Petrik .
3,863,237 * 1/1975 Doerr .
4,003,100 * 1/1977 Whitaker .
4,176,419 * 12/1979 MacDonald .
4,198,720 * 4/1980 Matsumoto .
4,225,437 * 9/1980 Woodard ..... 210/223
4,247,216 * 1/1981 Pansini .
4,466,152 * 8/1984 Moss et al. .
4,659,125 * 4/1987 Chuan .
5,487,397 * 1/1996 Bean .
5,536,107 * 7/1996 Baker .
5,705,058 * 1/1998 Fischer ..... 210/169
5,738,399 * 4/1998 Mitchell .

* cited by examiner

*Primary Examiner*—W. L. Walker
*Assistant Examiner*—Marianne S. Ocampo

(57) ABSTRACT

A pool scoop for providing a rigid scoop for lifting items off of the bottom of a pool. The pool scoop includes a pole with tubular attachment sleeve at a distal end of the pole. A scoop member is provided having a bottom wall, a pair of spaced apart side walls upwardly extending from the bottom wall, and an end wall upwardly extending from the bottom wall between the side walls. The scoop member has a front edge extending along the bottom wall between the side walls opposite the end wall. The bottom wall also has a plurality of apertures of a predetermined size therethrough. An extent extends from the end wall of the scoop member and is inserted into a second end of the attachment sleeve.

1 Claim, 2 Drawing Sheets

POOL SCOOP

BACKGROUND OF THE INVENTION

1. Field of the Invention

The present invention relates to pool cleaning devices and more particularly pertains to a new pool scoop for providing a rigid scoop for lifting items off of the bottom of a pool.

2. Description of the Prior Art

The use of pool cleaning devices is known in the prior art. More specifically, pool cleaning devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,176,419; 5,473,786; 4,225,437; 4,749,478; U.S. Pat. Nos. Des. 253,158; and 318,350.

While these devices fulfill their respective, particular objectives and requirements, the aforementioned patents do not disclose a new pool scoop. The inventive device includes a pole with tubular attachment sleeve at a distal end of the pole. A scoop member is provided having a bottom wall, a pair of spaced apart side walls upwardly extending from the bottom wall, and an end wall upwardly extending from the bottom wall between the side walls. The scoop member has a front edge extending along the bottom wall between the side walls opposite the end wall. The bottom wall also has a plurality of apertures of a predetermined size therethrough. An extent extends from the end wall of the scoop member and is inserted into a second end of the attachment sleeve.

In these respects, the pool scoop according to the present invention substantially departs from the conventional concepts and designs of the prior art, and in so doing provides an apparatus primarily developed for the purpose of providing a rigid scoop for lifting items off of the bottom of a pool.

SUMMARY OF THE INVENTION

In view of the foregoing disadvantages inherent in the known types of pool cleaning devices now present in the prior art, the present invention provides a new pool scoop construction wherein the same can be utilized for providing a rigid scoop for lifting items off of the bottom of a pool.

The general purpose of the present invention, which will be described subsequently in greater detail, is to provide a new pool scoop apparatus and method which has many of the advantages of the pool cleaning devices mentioned heretofore and many novel features that result in a new pool scoop which is not anticipated, rendered obvious, suggested, or even implied by any of the prior art pool cleaning devices, either alone or in any combination thereof.

To attain this, the present invention generally comprises a pole with tubular attachment sleeve at a distal end of the pole. A scoop member is provided having a bottom wall, a pair of spaced apart side walls upwardly extending from the bottom wall, and an end wall upwardly extending from the bottom wall between the side walls. The scoop member has a front edge extending along the bottom wall between the side walls opposite the end wall. The bottom wall also has a plurality of apertures of a predetermined size therethrough. An extent extends from the end wall of the scoop member and is inserted into a second end of the attachment sleeve.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new pool scoop apparatus and method which has many of the advantages of the pool cleaning devices mentioned heretofore and many novel features that result in a new pool scoop which is not anticipated, rendered obvious, suggested, or even implied by any of the prior art pool cleaning devices, either alone or in any combination thereof.

It is another object of the present invention to provide a new pool scoop which may be easily and efficiently manufactured and marketed.

It is a further object of the present invention to provide a new pool scoop which is of a durable and reliable construction.

An even further object of the present invention is to provide a new pool scoop which is susceptible of a low cost of manufacture with regard to both materials and labor, and which accordingly is then susceptible of low prices of sale to the consuming public, thereby making such pool scoop economically available to the buying public.

Still yet another object of the present invention is to provide a new pool scoop which provides in the apparatuses and methods of the prior art some of the advantages thereof, while simultaneously overcoming some of the disadvantages normally associated therewith.

Still another object of the present invention is to provide a new pool scoop for providing a rigid scoop for lifting items off of the bottom of a pool.

Yet another object of the present invention is to provide a new pool scoop which includes a pole with tubular attachment sleeve at a distal end of the pole. A scoop member is provided having a bottom wall, a pair of spaced apart side walls upwardly extending from the bottom wall, and an end wall upwardly extending from the bottom wall between the side walls. The scoop member has a front edge extending along the bottom wall between the side walls opposite the end wall. The bottom wall also has a plurality of apertures of a predetermined size therethrough. An extent extends from the end wall of the scoop member and is inserted into a second end of the attachment sleeve.

Still yet another object of the present invention is to provide a new pool scoop that allows a user to lift keys, pebbles and other small objects off of the bottom of a pool that are otherwise too difficult to remove with a traditional pool cleaning net.

Even still another object of the present invention is to provide a new pool scoop that is easily attachable to standard pool cleaning poles.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
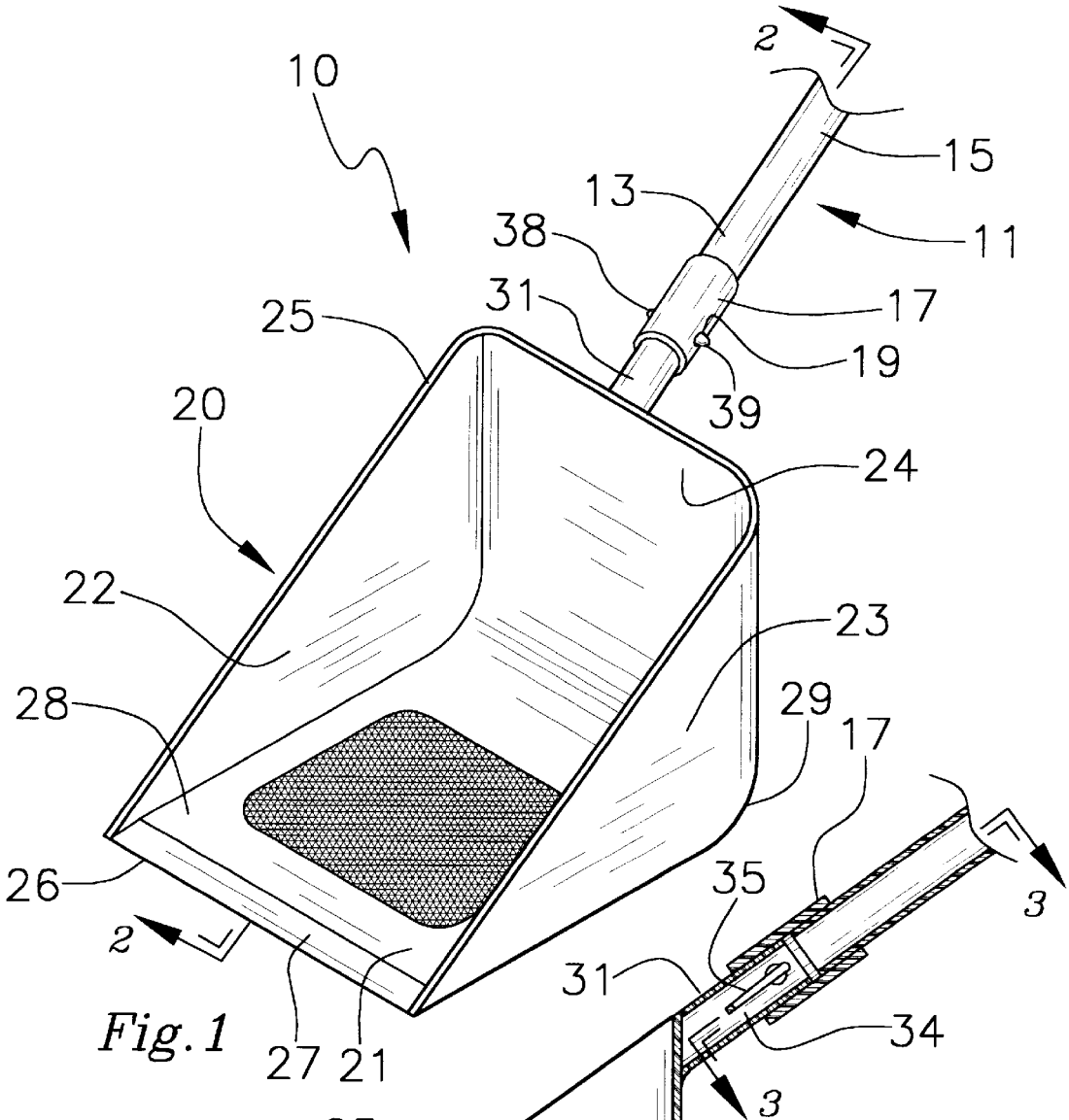
FIG. 1 is a schematic perspective view of a scoop member of a new pool scoop according to the present invention.
Figure 2:
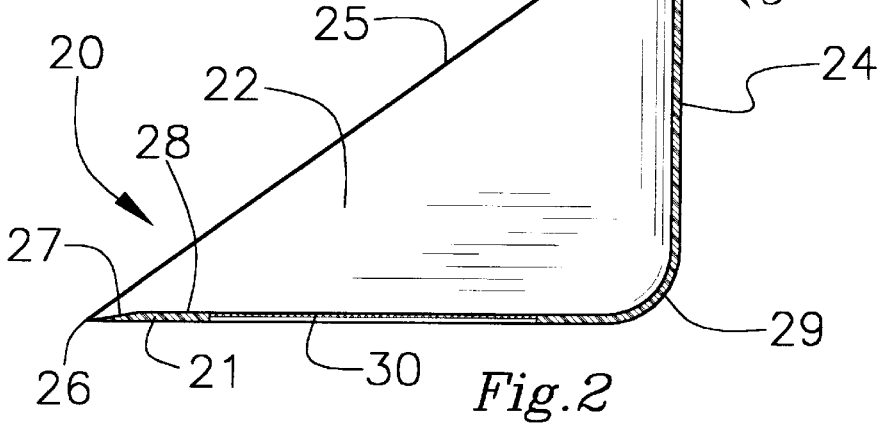
FIG. 2 is a schematic cross sectional view taken from line 2—2 of FIG. 1.
Figures 3, 4:
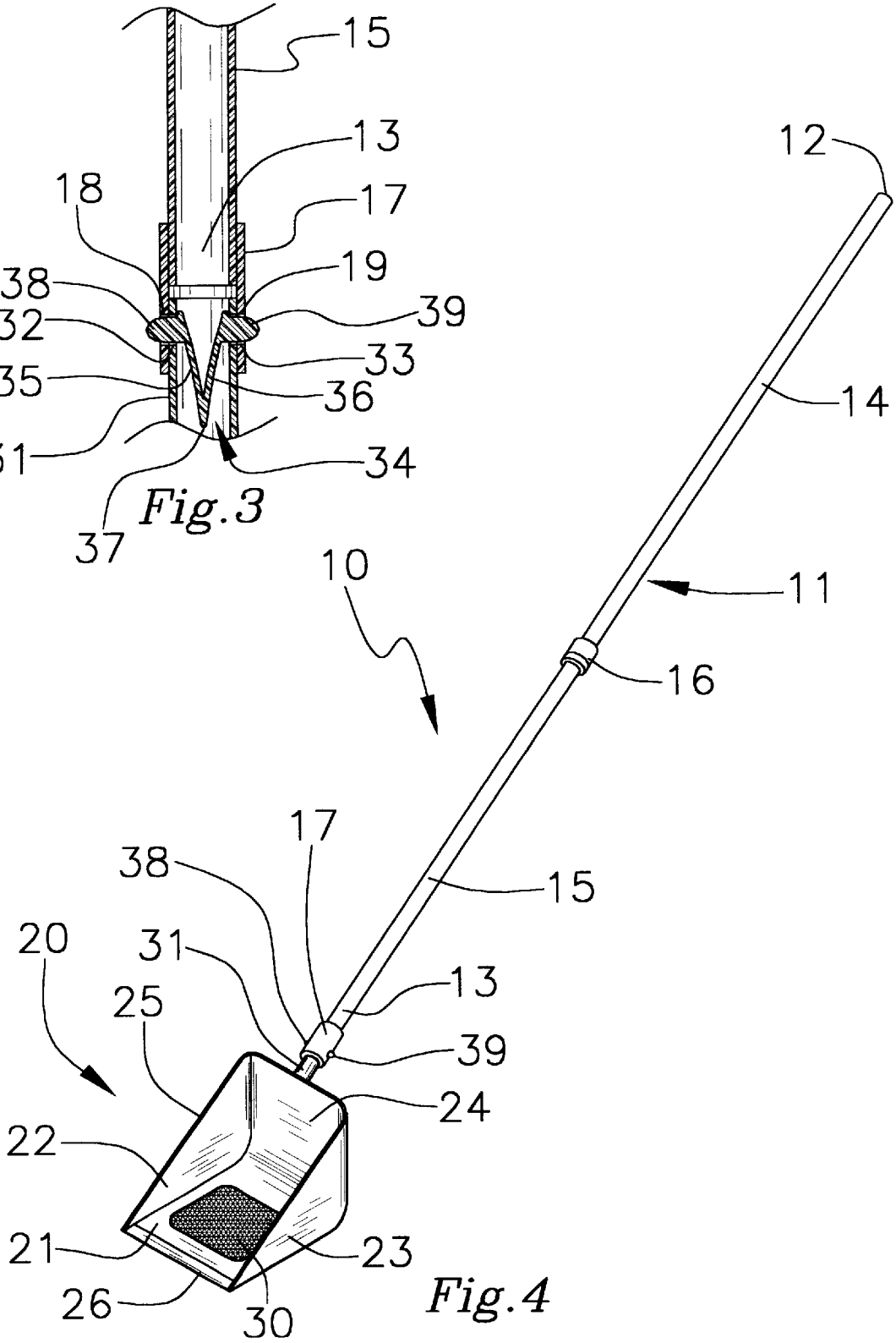
FIG. 3 is a schematic cross sectional view taken from line 3—3 of FIG. 2.
FIG. 4 is a schematic perspective view of the present invention.

With reference now to the drawings, and in particular to FIGS. 1 through 4 thereof, a new pool scoop embodying the principles and concepts of the present invention and generally designated by the reference numeral 10 will be described.

As best illustrated in FIGS. 1 through 4, the pool scoop 10 generally comprises a pole with tubular attachment sleeve at a distal end of the pole. A scoop member is provided having a bottom wall, a pair of spaced apart side walls upwardly extending from the bottom wall, and an end wall upwardly extending from the bottom wall between the side walls. The scoop member has a front edge extending along the bottom wall between the side walls opposite the end wall. The bottom wall also has a plurality of apertures of a predetermined size therethrough. An extent extends from the end wall of the scoop member and is inserted into a second end of the attachment sleeve.

In use, the pool scoop 10 is designed for scooping items off of the bottom of a pool. Specifically, the pool scoop includes a telescopically extendable elongate pole 11 has opposite proximal and distal ends 12,13, an elongate proximal portion 14 adjacent the proximal end, and an elongate distal portion 15 adjacent the distal end. The distal portion is telescopically inserted into the proximal portion such that the distal portion is telescopically extendable from the proximal portion of the pool. Preferably, the pole has a retaining collar 16 rotatably disposed therearound for releasably holding the distal portion of the pole in a fixed position with respect to the proximal portion of the pole.

A generally cylindrical tubular attachment sleeve 17 with a pair of opposite open ends is also included. The distal end of the pole is inserted into a first of the open ends of the attachment sleeve. The attachment sleeve also has a pair of diametrically opposite attachment holes 18,19 therethrough positioned adjacent a second of the open ends of the attachment sleeve.

A scoop member 20 is also included having a generally triangular wedge-shaped configuration and comprising a generally rectangular bottom wall 21, a pair of spaced apart generally triangular side walls 22,23 upwardly extending from the bottom wall, and a generally rectangular end wall 24 upwardly extending from the bottom wall between the side walls. The scoop member has a generally U-shaped upper edge 25 extending along the top of the side walls and the end wall, and a front edge 26 extending along the bottom wall between the side walls opposite the end wall.

Preferably, the upper edge of the scoop member lies in a plane extending at an acute angle to the bottom wall of the scoop member. The bottom wall of the scoop member preferably has a tapered portion 27 extending adjacently to the front edge of the scoop member. The tapered portion of the bottom wall tapers towards the front edge and lies in a plane extending at an obtuse angle to an upper surface 28 of the bottom wall. In use, the front edge and tapered portion are designed for helping scoop objects off of the bottom of a pool onto the scoop member.

The bottom and end walls preferably form a rounded corner 29 therebetween extending between the side walls. The rounded corner is designed for permitting pivoting of scoop member on the bottom of a pool such that the front edge of the scoop member is lifted off of the bottom of the pool to capture objects scooped off of the bottom of the pool by the scoop member.

The bottom wall has a generally rectangular opening therethrough and a generally rectangular mesh screen 30 substantially occupying the space of the opening of the bottom wall. The mesh screen of the bottom wall has a plurality of apertures therethrough designed for permitting the draining of water from the scoop member after it is lifted out of the pool so that all that remains in the scoop member are the objects scooped off the bottom of the pool.

A generally cylindrical tubular extent 31 outwardly and upwardly extends from the end wall of the scoop member. The extent is preferably upwardly extended at an obtuse angle to a plane in which the end wall lies. The extent has a pair of opposite ends with a first of the ends of the extent coupled to the end wall adjacent the upper edge of the scoop member. The extent has a pair of diametrically opposite holes 32,33 therethrough adjacent a second of the ends of the extent. The second end of the extent is inserted into the second open end of the attachment sleeve.

Preferably, a fastener detachably attaches the extent to the attachment sleeve. The fastener ideally comprises a generally V-shaped spring 34 has a pair of elongate resiliently deflectable leaves 35,36 coupled together at an end vertex 37 of the spring. The spring of the fastener is disposed in the extent with the end vertex pointing towards the end wall of the scoop member. Each of the leaves of the spring has a free end and an outwardly extending bullet-shaped detent 38,39 adjacent the free end of the respective leaf Each of the holes of the extent is coaxially aligned with an associated attachment hole of the attachment sleeve. The detent of a first of the leaves is inserted into the a first attachment hole of the attachment sleeve and the associated coaxially aligned hole of the extent. Similarly, the detent of a second of the leaves is inserted is inserted into the a second attachment hole of the attachment sleeve and the associated coaxially aligned hole of the extent. The leaves of the spring biasing the detents away from each other such that each of the detents is biased into the respective pair of associated holes of the attachment sleeve and extent to hold the extent to the attachment sleeve.

In an ideal illustrative embodiment, the scoop member has a height defined across the end wall between the upper edge and bottom wall of about 7 inches, a length defined across the bottom wall between the end wall and the front edge of about 8 inches and a width defined between the side walls of about 8 inches for providing optimal dimensions for scooping up most small objects in a pool and still permitting easy maneuverability and lifting of the scoop member in the pool.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pool scoop, comprising:

a telescopically extendable elongate pole having opposite proximal and distal ends, an elongate proximal portion adjacent said proximal end, and an elongate distal portion adjacent said distal end and telescopically inserted into said proximal portion such that said distal portion is telescopically extendable from said proximal portion of said pool;

said pole having a retaining collar rotatably disposed therearound for releasably holding said distal portion of said pole in a fixed position with respect to said proximal portion of said pole;

a generally cylindrical tubular attachment sleeve having a pair of opposite open ends, said distal end of said pole being inserted into a first of said open ends of said attachment sleeve;

said attachment sleeve having a pair of diametrically opposite attachment holes therethrough positioned adjacent a second of said open ends of said attachment sleeve;

a scoop member having a generally triangular wedge-shaped configuration and comprising a generally rectangular bottom wall, a pair of spaced apart generally triangular side walls upwardly extending from said bottom wall, and a generally rectangular end wall upwardly extending from said bottom wall between said side walls;

said scoop member having a generally U-shaped upper edge extending along said side walls and said end wall, and a front edge extending along said bottom wall between said side walls opposite said end wall;

said upper edge of said scoop member lying in a plane extending at an acute angle to said bottom wall of said scoop member;

said bottom wall of said scoop member having a tapered portion extending adjacently to said front edge of said scoop member, said tapered portion of said bottom wall tapering towards said front edge, said lying in a plane extending at an obtuse angle to an upper surface of said bottom wall;

said front edge and said tapered portion being adapted for helping scoop objects off of a bottom of a pool onto said scoop member;

said bottom and end walls forming a rounded corner therebetween extending between said side walls;

said rounded corner being adapted for permitting pivoting of said scoop member on the bottom of the pool such that said front edge of said scoop member is lifted off of the bottom of the pool to capture objects scooped off of the bottom of the pool by said scoop member;

said bottom wall having a generally rectangular opening therethrough and a generally rectangular mesh screen substantially occupying the space of said opening of said bottom wall, said mesh screen of said bottom wall having a plurality of apertures therethrough adapted for permitting the draining of water from said scoop member after said scoop member is lifted out of the pool such that all that remains in said scoop member are the objects scooped off of the bottom of the pool;

a generally cylindrical tubular extent outwardly and upwardly extending from said end wall of said scoop member, said extent being upwardly extended at an obtuse angle to a plane in which said end wall lies;

said extent having a pair of opposite ends, a first of said ends of said extent being coupled to said end wall adjacent said upper edge of said scoop member;

said extent having a pair of diametrically opposite holes therethrough adjacent a second of said ends of said extent;

said second end of said extent being inserted into said second open end of said attachment sleeve;

a fastener detachably attaching said extent to said attachment sleeve;

said fastener comprising a generally V-shaped spring having a pair of elongate resiliently deflectable leaves coupled together at an end vertex of said spring;

said spring of said fastener being disposed in said extent with said end vertex pointing towards said end wall of said scoop member;

each of said leaves of said spring having a free end and an outwardly extending detent adjacent said free end of the respective leaf;

each of said holes of said extent being coaxially aligned with an associated attachment hole of said attachment sleeve;

said detent of a first of said leaves being inserted into a first of said attachment holes of said attachment sleeve and the associated coaxially aligned hole of said extent and said detent of a second of said leaves being inserted into a second of said attachment of said attachment sleeve and the associated coaxially aligned hole of said extent;

said leaves of said spring biasing said detents away from each other such that each of said detents is biased into the respective pair of associated holes of said attachment sleeve and extent to hold said extent to said attachment sleeve;

wherein a height of said end wall is greater than half of a length of said bottom wall, said end wall being at a right angle to said bottom wall such that said end wall is adapted for resisting objects collected from a bottom of a pool from flowing over said end wall and out of said scoop member with water in the pool moving across said scoop member; and wherein a height of said scoop member is defined across said end wall between said upper edge and said bottom wall of about 7 inches, said length defined across said bottom wall between said end wall and said front edge of about 8 inches and a width defined between said side walls of about 8 inches for providing optimal dimensions for scooping up most small objects in the pool and still permitting easy maneuverability and lifting of said scoop member in the pool.

* * * * *